United States Patent [19]

Rothenbucher

[11] Patent Number: 4,624,379

[45] Date of Patent: Nov. 25, 1986

[54] LETHAL SERVICE HEADER BOX

[75] Inventor: Robert K. Rothenbucher, Claremore, Okla.

[73] Assignee: Smithco Engineering, Tulsa, Okla.

[21] Appl. No.: 698,185

[22] Filed: Feb. 4, 1985

[51] Int. Cl.[4] ..... B65D 6/32

[52] U.S. Cl. ..... 220/4 R; 220/1 R; 220/5 A; 220/72; 220/DIG. 29

[58] Field of Search ..... 220/1 R, 4 R, 5 A, 5 R, 220/75, DIG. 29

[56] References Cited

U.S. PATENT DOCUMENTS

| | | | |
|---|---|---|---|
| 1,921,241 | 8/1933 | Priebe | 220/5 A |
| 2,179,774 | 11/1939 | Zerbe | 220/DIG. 29 |
| 2,290,515 | 7/1942 | Williams | 220/DIG. 29 |
| 2,370,304 | 2/1945 | Grant | 220/DIG. 29 |
| 4,015,071 | 3/1977 | Peet | 220/DIG. 29 |

*Primary Examiner*—George E. Lowrance

*Attorney, Agent, or Firm*—Head, Johnson & Stevenson

[57] ABSTRACT

A lethal service header box for use in manufacturing an air cooled heat exchanger having a front and a back plate, a top and a bottom plate and a left and a right end plate, each of the six plates having a planar external surface and each having an internal surface configured such that the header box is assembled by welding together the six plates, all welding being accomplished exteriorly of the box and within a wedge shaped cross-sectional environment in which the inner terminus of each weld cross-section is at a narrow weld ledge of at least one of the plates.

2 Claims, 9 Drawing Figures

LETHAL SERVICE HEADER BOX

SUMMARY OF THE INVENTION

An item of equipment frequently employed in industrial applications, and particularly in the petroleum and chemical industries, is the air cooled heat exchanger. Exchanging heat between a fluid medium with the atmosphere is successfully accomplished by flowing the fluid medium, whether a liquid or a gas, through a series of finned tubes. By means of a fan air is drawn across the fin tubes.

Heat exchangers are univerally manufactured for industrial applications by use of two spaced apart header boxes. Finned tubes extend between these header boxes. The finned tubes are typically placed close together with a fan for moving air positioned adjacent them. The header boxes provide means of both physically supporting the finned tubes and of providing fluid communication with the interior of the tubes. The typical header box is a closed six sided housing which is usually formed by welding steel plates.

A problem exists in the construction of header boxes for use in air cooled heat exchangers wherein the fluid medium is classified as lethal, that is, a fluid medium which would be dangerous to life if permitted to escape from the heat exchanger. Lethal substances are defined as poisonous gases or liquids of such a nature that a very small amount of the gas or the vapor of the liquid mixed or unmixed with air is dangerous to life when inhaled. In order to insure safety of heat exchangers classified for lethal service industrial standards require rigid X-ray examination of the welded header boxes. Since the box is a closed entity a serious problem has been to achieve an effective X-ray examination of all of the welds forming a box when the box is welded in the typical manner as employed in the past utilizing flat plates.

The present invention is directed towards a header box which facilitates not only the efficient and economic manufacture of a box having high structural strength and leak proof integrity but one which is capable of X-ray examination as necessary to verify the integrity of X-ray examination as necessary to verify the integrity of the wells to permit the manufactured box to be classified as suitable for use in lethal applications.

A header box capable of X-ray verification of the welds is achieved in this invention by a unique configuration of the six plates required to formulate the rectangular box. The six plates include vertical front and back plates, horizontal top and bottom plates, and vertical left and right end plates. The front plate has a vertical planar front surface and a generally planar rear surface. A groove is formed in the rear surface around the entire periphery thereof, the groove being spaced from the plate top bottom and side edges. The rear surface of the plate is then beveled around the full periphery which provides a narrow width weld ledge between the bevel and the groove. This welding ledge is in the plane of the front plate rearward surface.

The back plate is manufactured exactly as the front plate and is merely the obverse of it.

The right end plate has an outer planar surface. The inner surface is defined by a central planar surface. An integral raised portion of increased plate thickness is provided along and spaced from the top and bottom edges of the plate. The top and bottom integral raised portions are beveled to provide a narrow width top and bottom portion welding ledge.

The left end plate is manufactured exactly as the right end plate and is the obverse of it.

A front plate is employed having planar top and bottom surfaces and the bottom plate is of like configuration.

The plates are positioned in juxtaposed relationship to form a closed box and welded at the full peripheral edge of each plate. Each weld is accomplished from outside the formed box and within a wedge-shaped cross-sectional environment. The inner terminous of each weld cross-section is at a narrow weld ledge of at least one of the plates.

The provision of the grooves in the front and back plate and of the integral increased width portion along the top and bottom edges of the end plates provide means so that the box when welding has been accomplished can be effectively x-rayed to verify the integrity of the welds and thereby verify that the box, as constructed, meets the industrial requirements for use in the manufacture of an air cooled heat exchanger useable for lethal service.

DETAILED DESCRIPTION OF THE PREFERRED EMBODIMENT OF THE INVENTION

Figure 1:
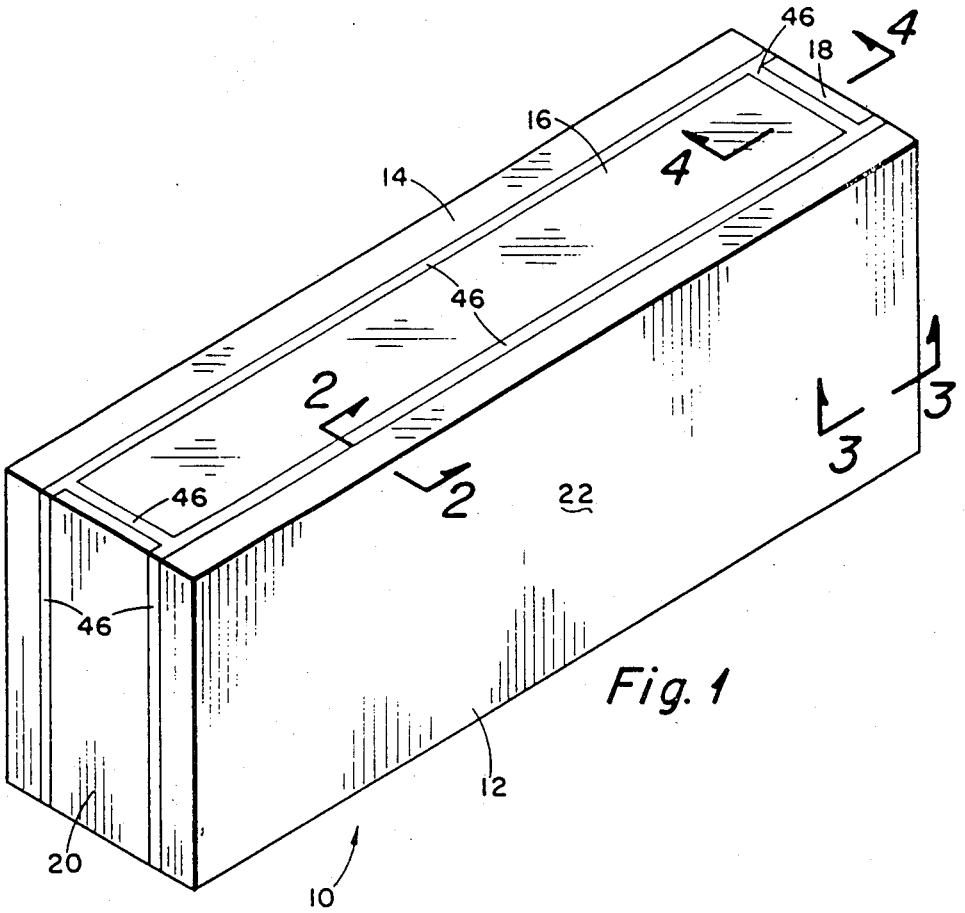
FIG. 1 is an isometric view of a completed header box as used in the manufacture of an air cooled heat exchanger useable for lethal service according to this invention.

Referring to the drawings and first to FIG. 1 a box which is useable in the manufacture of a heat exchanger, and which meets requirements for use is lethal service is indicated by the numeral 10. The box is formed of six plates, that is, a vertical front plate 12, a vertical back plate 14, a horizontal top plate 16, a horizontal bottom plate not seen in FIG. 1, a vertical right end plate 18 and a vertical left end plate 20.

Figure 3:
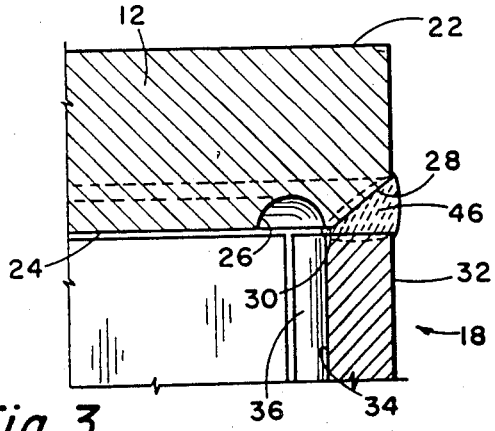
FIG. 3 is a fragmentary cross-sectional view taken along the line 3—3 of FIG. 1 showing the intersection of the front plate and the right end plate.
Figure 2:
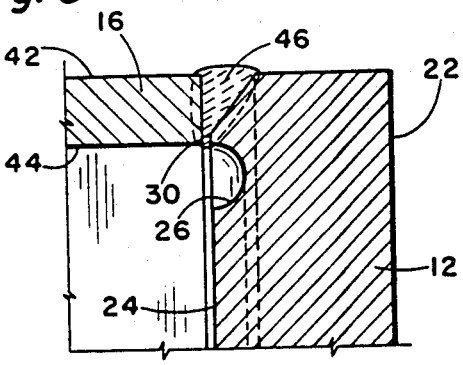
FIG. 2 is a fragmentary cross-sectional view taken along the line 2—2 of FIG. 1 showing the intersection of the front and top plates.

The front plate 12 is seen in cross-section in FIGS. 2 and 3. The rearward or inside surface is shown in elevation in FIG. 5 and an end view is shown in FIG. 6. The front plate 12 has a vertical planar front surface 22 and a generally planar vertical rear surface 24. The rear surface 24 has a groove 26 around the periphery thereof. Groove 26 is spaced from the plate edges. The plate is beveled at 28 around its entire periphery. The groove 26 and bevel 28 provides a narrow width welding ledge 30 around the entire periphery of the plate, the welding ledge 30 being in the plane of the plate rear surface 24.

Figure 5:
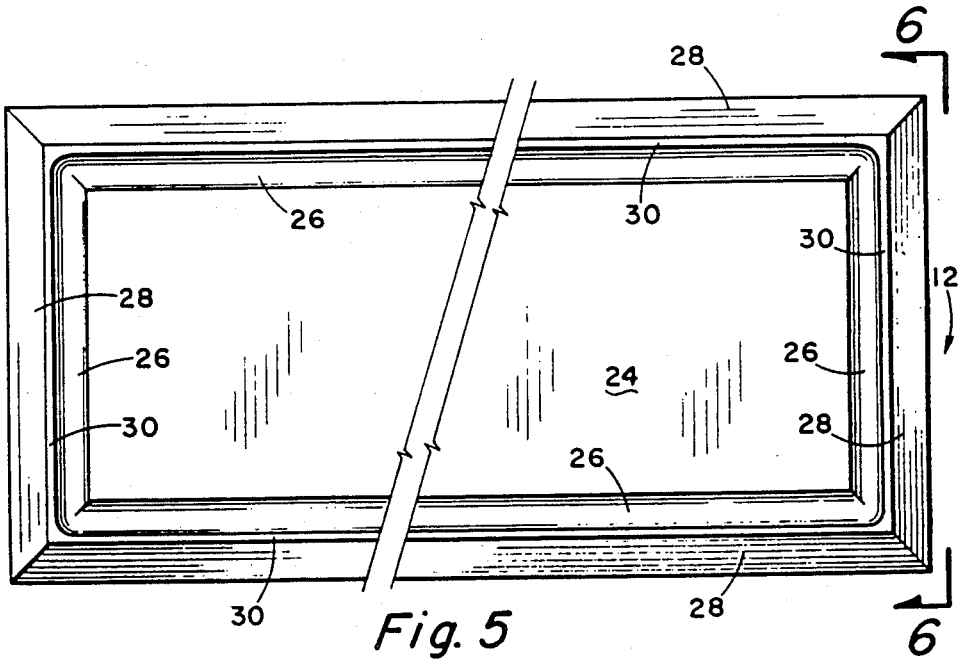
FIG. 5 is an elevational view of the inside of the front plate, which view is the same for the inside of the back plate.
Figure 6:
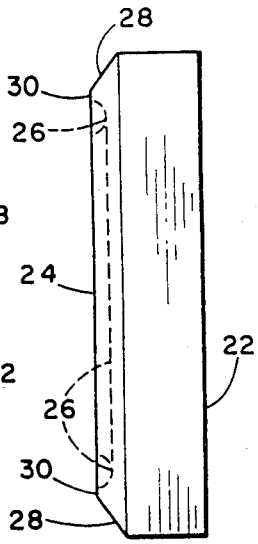
FIG. 6 is an end view as taken along the line 6—6 of FIG. 5 of the front plate, which view is the same for the back plate.

The rear plate 14 is configured exactly like front plate 12 except it is the obverse thereof, that is, the front surface of the rear plate is configured as illustrated in FIG. 5.

Figure 7:
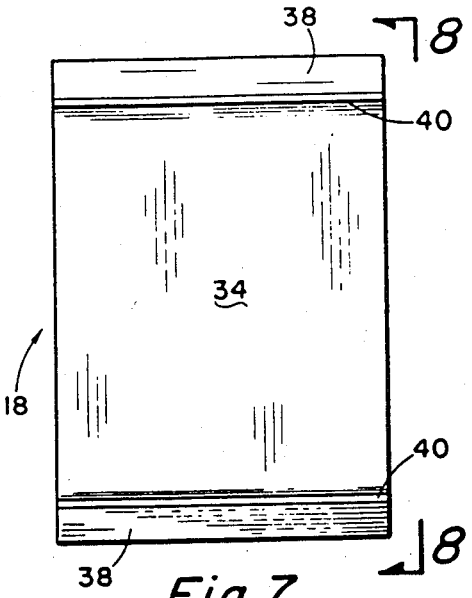
FIG. 7 is an elevational view of the inner surface of the right end plate, which view would be the same for the inner surface of the left end plate.
Figure 8:
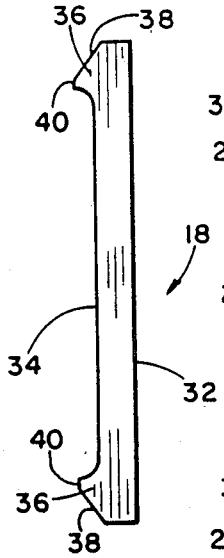
FIG. 8 is an elevational end view of the right end plate as taken along the line 8—8 of FIG. 7. The left end plate has the same elevational view.
Figure 4:
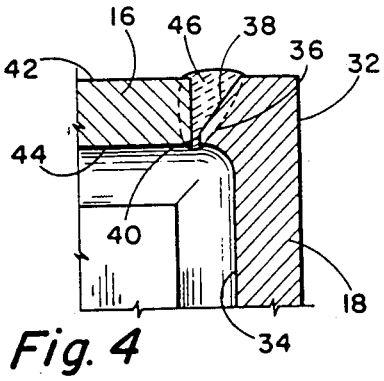
FIG. 4 is a fragmentary cross-sectional view taken along the line 4—4 of FIG. 1 and showing the intersection of the right end plate and the top plate.

The configuration of the right end plate 18 is shown in FIGS. 4, 7 and 8. The right end plate 18 has an outer planar surface 32 and an inner surface which is defined in part by a central planar surface 34. An integral raised portion of increased plate thickness 36 is provided adjacent the top and bottom edges of plate 18.

The top and bottom edges of the right end plate at the integral raised portions 36 are beveled at 38 to provide a top and bottom narrow width welding ledge 40.

The left end plate is constructed exactly the same as the right end plate 18 except it is the obverse thereof.

The top plate 16 is shown in FIGS. 2 and 4. The top plate has a planar top surface 42 and a planar bottom surface 44. The bottom plate is exactly the same as the top plate 16.

After the plates are formed as described they are assembled in juxtoposed relationship forming a box. The periphery of each of the plates is welded to the periphery of the adjacent plate the welds being indicated by numeral 46. By the construction of the plates each weld is accomplished from outside the formed box and within a wedge shaped cross-sectional environment as illustrated in FIGS. 2, 3 and 4. The inner terminus of each weld 46 being at a narrow ledge of at least one of the plates, that is, the bottom terminus of each weld is formed by a ledge 30 or 40. Since each weld is formed in a wedge shaped environment the weld is most easily and effectively accomplished. In addition, since each weld terminates at the inward portion thereof at a narrow welding ledge, the efficacy of the weld can be verified by X-ray.

Figure 2A:
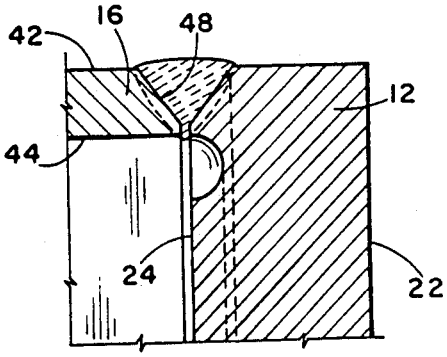
FIG. 2A is a fragmentary cross-sectional view as in FIG. 2 but showing an alternate construction of the top plate.

FIG. 2A shows an alternate embodiment of the top and bottom plates. As shown in FIG. 2A the top plates 16 has a bevel 48 on it peripheral edge, the bevel extending around the total periphery of the top plate. The bottom plate is such case would be manufactured in exactly the same way. The advantage of the alternate embodiment as shown in FIG. 2A is that the wedge shaped weld environment is further improved into a V-shaped cross-sectional area in which the weld is accomplished. It can be seen that if desired the vertical surfaces of the right and left end plates could be beveled in the same manner and in which case all of the wedge shaped weld environments could be thereby in the form of a V-shaped cross-section.

The box as formed, described and illustrated is useful, as previously indicated, in the manufacture of air cooled heat exchangers. In the usual application the front plate 12 and rear plate 14 are provided with aligner openings (not shown), there being an opening in each place for each finned tube. Normally the openings (not shown) in the front plate 12 are threaded and are closed by a plug which serves as a means of cleaning out the interior of the finned tubes. In addition, in the normal use of the header box as described herein one or more large diameter openings is provided in the top or bottom plates as a means of conveying fluid, either liquid or gas, to the box which is subsequently passed through finned tubes extending between boxes. These openings are not shown since they are standard and are not related to the improvements forming the invention.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A lethal service header box for use in manufacturing an air cooled heat exchanger, comprising:

a vertical front plate, a vertical back plate, a horizontal top plate, a horizontal bottom plate, a vertical left end plate and a vertical right end plate;

the front plate having a vertical planar front surface and a generally planar vertical rear surface having a groove around the periphery thereof, the groove being spaced from the plate edge, the edges of the plate being beveled around the full periphery thereof providing a narrow width welding ledge between the bevel and the groove, the welding ledge being in the plane of the rear surface;

the right end plate having an outer planar surface, and an inner surface which is defined by a central planar surface and an integral raised portion of increased plate thickness along and spaced from the top and bottom edges of the plate, and the top and bottom integral raised portions being beveled to provide a top and bottom welding ledge, the thickness of the right end plate being greatest at the welding ledge;

a top plate having a planar top surface and a planar bottom surface;

the back plate being configured as the obverse of the front plate, the left end plate being configured as the obverse of the right end plate, and the bottom plate being configured as the obverse of the top plate;

the plates being positioned in juxtaposed relationship to form a closed box and welded at the full peripheral edge of each plate, each weld being accomplished from outside the formed box and within a wedge shaped cross-sectional environment, the inner terminus of each weld cross-section being at a said narrow welding ledge of at least one of said plates.

2. A lethal service header box according to claim 1 wherein said top plate has a bevel formed on the the full periphery thereof, and wherein said bottom plate is the obverse of said top plate, whereby the weld around the periphery of the top and bottom plates is accomplished in a wedge shape cross-sectional environment which is also more particularly a V-shaped cross-sectional environment.

* * * * *